US005191973A

United States Patent [19]

Shteynberg

[11] Patent Number: 5,191,973

[45] Date of Patent: Mar. 9, 1993

[54] ADJUSTABLE PAINTBRUSH HOLDER

[75] Inventor: Boris Shteynberg, San Francisco, Calif.

[73] Assignee: Kass Enterprises, San Bruno, Calif.

[21] Appl. No.: 903,721

[22] Filed: Jun. 24, 1992

[51] Int. Cl.[5] ..... B65D 75/14; B65D 5/50

[52] U.S. Cl. ..... 206/15.2; 206/362.4; 206/491; 220/697

[58] Field of Search ..... 206/1.7, 361, 362, 15.2, 206/15.3, 362.4, 576, 577, 491, 492; 220/697; 229/112

[56] References Cited

U.S. PATENT DOCUMENTS

| | | | |
|---|---|---|---|
| 1,314,869 | 9/1919 | Gray | 229/112 X |
| 1,852,679 | 4/1932 | Schneider . | |
| 1,931,293 | 10/1933 | Morck | 206/362.4 |
| 2,057,828 | 10/1936 | Hartwell | 206/362.4 |
| 2,216,543 | 10/1940 | Schumann | 206/362.4 |
| 2,290,359 | 7/1942 | Ringler | 206/362.4 |
| 2,609,920 | 9/1952 | Ringler | 206/362.4 |
| 2,763,367 | 9/1956 | Schumann | 206/15.1 |
| 2,841,273 | 7/1958 | Scott | 206/362.4 |
| 2,979,189 | 4/1961 | Allen | 206/362.4 |
| 3,000,491 | 9/1961 | McIntosh | 206/361 |
| 4,606,456 | 8/1986 | Kaminski | 206/362.4 |

*Primary Examiner*—Paul T. Sewell
*Assistant Examiner*—Jacob K. Ackun, Jr.
*Attorney, Agent, or Firm*—David Pressman

[57] ABSTRACT

A paintbrush holder includes a central panel (12) which contains a first plurality of ventilation openings (14) and an inspection window (16). The central panel incorporates a strip-like raised portion (17). Score lines (18 and 20) separate the central panel and adjoining tapered first and second side panels (22 and 24). A score line (26) serves as a junction between a front panel (28) and the first side panel, while a score line (30) separates an intermediate panel (32) and the second side panel. A wedge-shaped cutout (33) is made in the first side panel and a square cutout (37) is formed in the intermediate panel. The intermediate panel contains a second plurality of ventilation openings (34) as well as a first snap fastener (36). The front panel has a square window (38) which in size and shape corresponds to the region outlined by the second plurality of ventilation openings. The front panel also includes second and third snap fasteners (42 and 44) and an opening (40), designed to mate with the first snap fastener. A score line (46) forms a boundary between the central panel and a spacer panel (48). A score line (50) forms a junction between the spacer panel and a bottom panel (52). Straps (54 and 56) are attached to the central panel. Each strap contains a plurality of openings for locking adjustably with the first and second snap fasteners.

18 Claims, 4 Drawing Sheets

ADJUSTABLE PAINTBRUSH HOLDER

BACKGROUND—FIELD OF INVENTION

The present invention relates to painting tools, particularly to an improved paintbrush holder for protecting a paintbrush before and after use.

BACKGROUND—DESCRIPTION OF PRIOR ART

Paintbrush holders made of cardboard, plastic, and other suitable materials are known and have been used in the past to protect a brush's bristles and ferrule during shipment, display, and storage of the brush.

One such holder, disclosed in U.S. Pat. No. 1,852,679 to Schneider, 1932, comprises a one-piece wrapper having several rectangular panels defined by crease lines. The device also incorporates a button and string closure.

However, this paintbrush holder has several drawbacks, one of which is its inability to accommodate brushes of different thicknesses. Moreover, once the brush is placed into the wrapper, it is impossible to determine the shape of the brush (straight or angled), the texture of the bristles (fine or coarse), and the material of the bristles without unwrapping the brush. Thus, this holder is inconvenient for display purposes and for between-use storage of the brush. Furthermore, the construction of the wrapper does not allow the bristles to be ventilated. Instead, moisture from the bristles is absorbed and dissipated by the wrapper material. However, should the wrapper material become saturated with water or solvent used to clean the brush, deterioration of bristles through rotting or mildew may occur.

Another display wrapper, described in U.S. Pat. No. 2,763,367 to Schumann, 1956, has a one-piece design which incorporates a window for assessing the length of the bristles. The construction of the wrapper provides a large opening so that the ends of the bristles are exposed for display and ventilation purposes.

However, such a large opening does not provide full protection of the bristles, necessitating the addition of a protective strip which must be attached to the wrapper by adhesive or other suitable permanent means. Although the strip provides added protection for the bristles, the brush can not be removed from the wrapper once the protective strip is in place. Thus, the wrapper is unsuitable for between-use storage. Moreover, the wrapper lacks adjustability for different brush thicknesses. Furthermore, the opening designed to accept the handle of the brush is not adjustable for different brush-handle shapes and sizes.

A paintbrush package, disclosed in U.S. Pat. No. 4,606,456 to Kaminski, 1986, comprises a cross-shaped blank cut from a sheet of pliant material and scored with multiple fold lines for assembly.

Even though this paintbrush package can be adjusted for brushes with different thicknesses and lengths, the adjustable member of the package lacks rigidity and is likely to collapse, leaving the brush loose inside the package.

OBJECTS AND ADVANTAGES

It is accordingly an object of the invention to provide a paintbrush holder which overcomes the foregoing disadvantages, which can display and ventilate the brush bristles while still providing a high degree of protection of the bristles and ferrule, which accommodates brushes of a given width with different ferrule thicknesses, different bristle lengths, and varying handle cross-sections, and which is simple and inexpensive to manufacture. Further objects and advantages will become apparent after consideration of the ensuing description and the accompanying drawings.

DRAWING FIGURES

REFERENCE NUMERALS USED IN THE DRAWINGS AND DESCRIPTION

Figure 1:
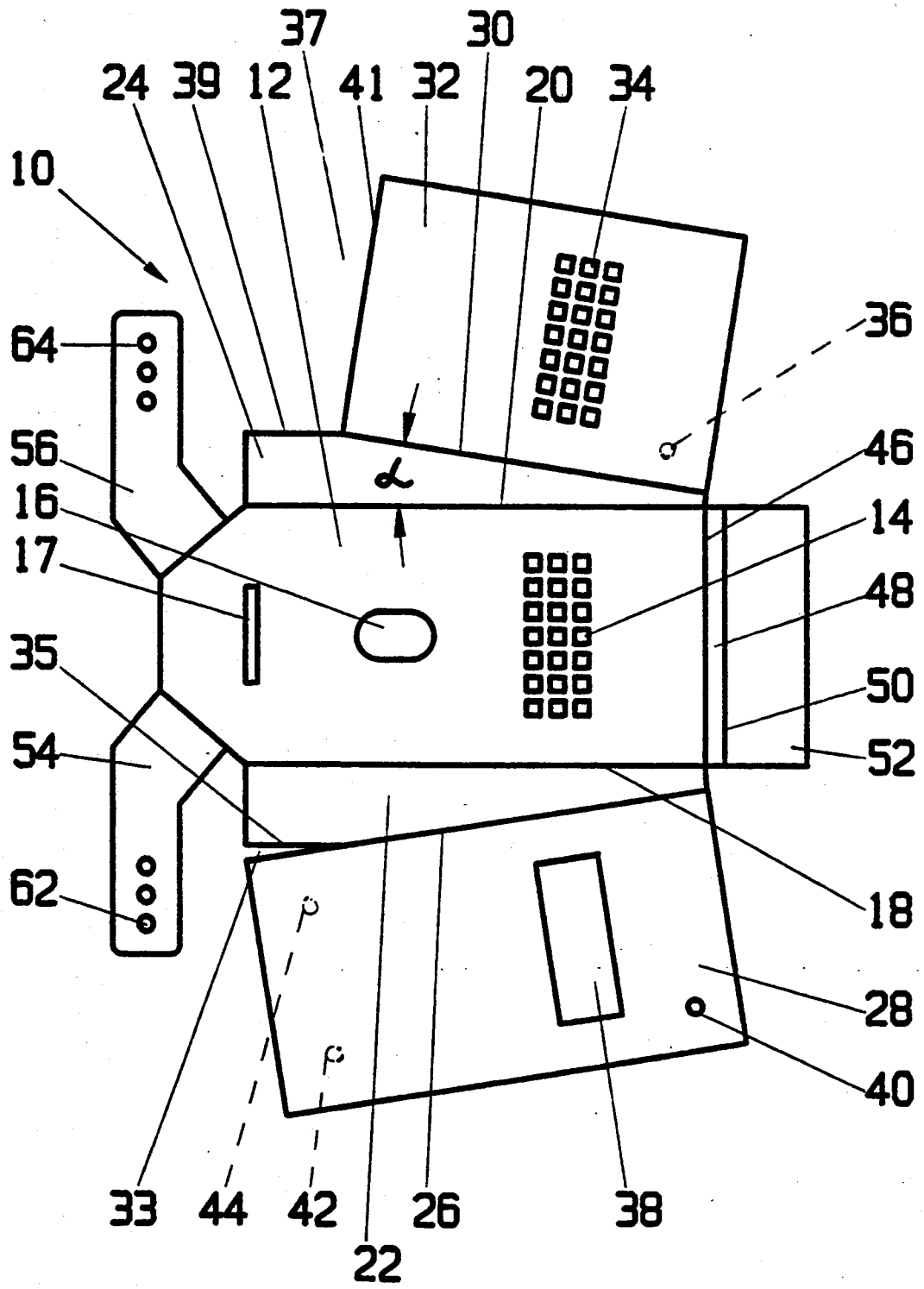
FIG. 1 is a plan view of a paintbrush holder of the invention in an unfolded state.

10—flat blank
12—central panel
14, 34—ventilation openings
16—inspection window
17—raised strip
18, 20, 26, 30, 46, 50—score lines
22, 24—side panels
28—front panel
32—intermediate panel
33—wedge-shaped cutout
35, 39, 41—edges
37—cutout
36, 42, 44—snap fasteners
40, 62, 64—openings
38—square opening
48—spacer panel
52—bottom panel
54, 56—straps
66—paintbrush
68—brush handle
70—ferrule
72—bristles

FIGS. 1 AND 2—DESCRIPTION

A plan view of an unfolded paintbrush holder according to the present invention is shown in FIG. 1.

The paintbrush holder comprises a flat blank 10, which is made of a suitable material, e.g., plastic. Blank 10 includes a central panel 12, located between adjoining tapered side panels 22 and 24. Panel 12 contains a plurality of ventilation openings 14, an inspection window 16, and a raised strip 17. Parallel score lines 18 and 20 separate panel 12 from panels 22 and 24.

The holder also contains a front panel 28 and an intermediate panel 32 joined to panels 22 and 24 by score lines 26 and 30, respectively. Line 26 is inclined at an angle $\alpha$ with respect to line 18. Line 30 forms an angle of the same size with line 20. Panel 22 contains a wedge-shaped cutout 33, such that it is defined by line 26 and an edge 35 which is parallel to lines 18 and 20. Panel 32 contains a plurality of ventilation openings 34, a snap fastener 36, and a cutout 37, which is defined by edges 39 and 41. Edge 39 has the same length as and is parallel to edge 35. Panel 28 has a square opening 38 which forms a region whose size and shape corresponds to that outlined by openings 34. Panel 28 also includes snap fasteners 42 and 44, each having a stem and a flared head, and an opening 40, designed to mate with fastener 36.

A spacer panel 48 is attached to the bottom of panel 12 at a score line 46. Bottom panel 52 is joined to panel 48 through a score line 50.

Straps 54 and 56 are located at the top of panel 12. Strap 54 has a plurality of openings 62 for locking adjustably with fastener 44 and strap 56 contains a plurality of openings 64 for locking adjustably with fastener 42.

Figure 2:
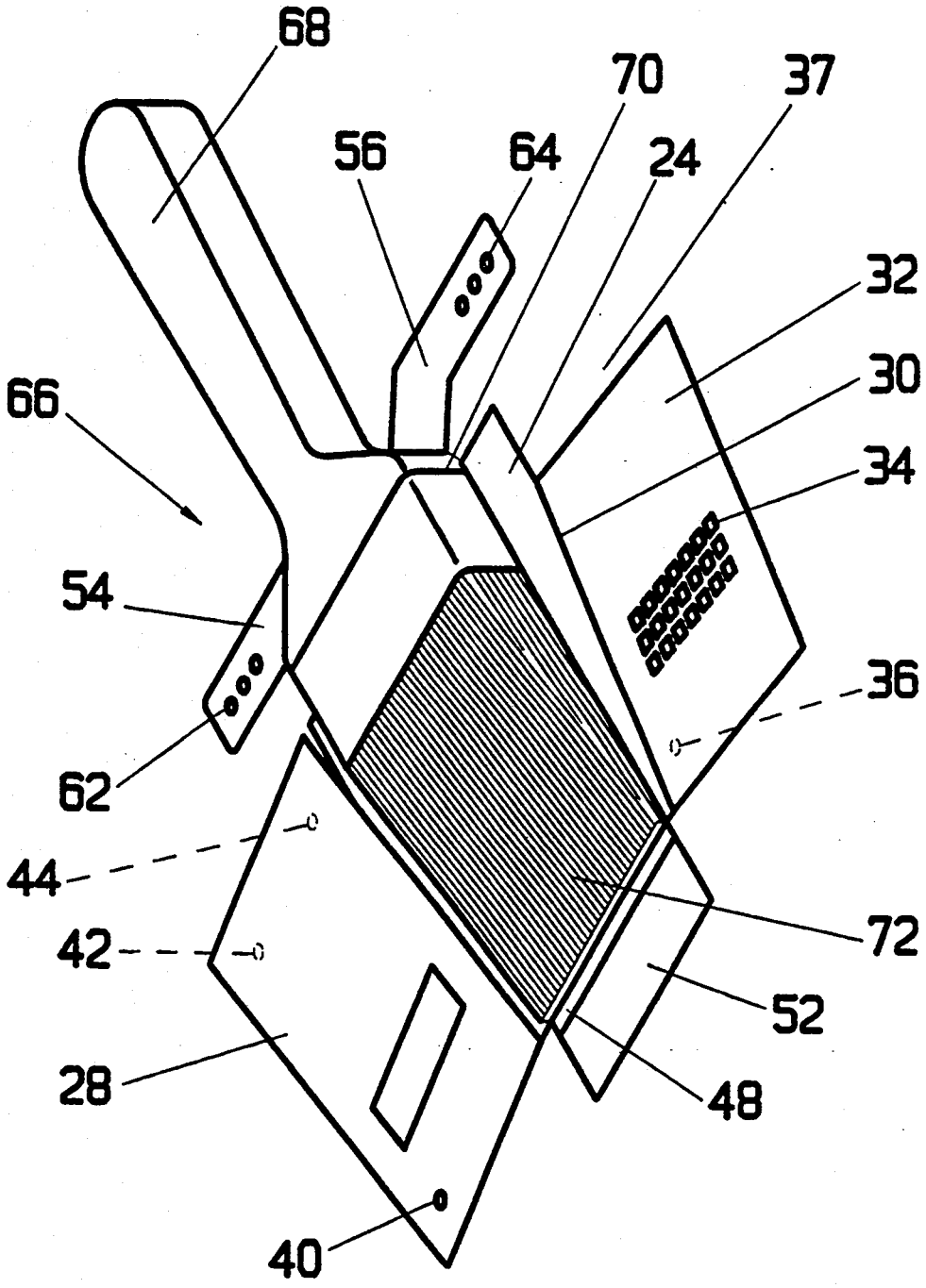
FIG. 2 is a plan view of a brush and the holder of FIG. 1, the brush being in a position just before folding the holder.

As shown in FIG. 2, a paintbrush 66, which is to be enclosed in the holder, generally comprises a brush handle 68, a ferrule 70, and bristles 72.

For example, the holder designed to accommodate a brush with a 2.5"-wide ferrule has side panels tapered at an angle of approximately 10° and is approximately 3 mm thick. Height of raised strip 17 is about 3 mm and length of panel 28 is approximately 12.5 cm.

FIGS. 2 THROUGH 4—OPERATION

Paintbrush 68 is enclosed in the holder either at the manufacturing facility to protect it during shipping, or after the brush is used and cleaned. In the latter case the brush can be enclosed in the holder while still moist with solvent. The brush is enclosed in accordance with the following, generally chronological steps.

As shown in FIG. 2, the holder is unfolded and paintbrush 68 is laid flat on top of the holder such that the head of the brush fits within the contours of panel 12. Brush handle 68 should protrude between straps 54 and 56. Panel 32 is then folded inwardly along line 30, thus making panel 24 vertical so that panel 24 is adjacent the right side of ferrule 70. Similarly, when panel 52 is folded over panel 32, panel 48 is made vertical so as to protect the ends of bristles 72.

Panel 28 is then folded along line 26, whereby panel 22 is pulled upright, thus bracing the ferrule of the brush from the left side. Once panel 28 is folded, fastener 36 is snapped into opening 40, interlocking panels 32 and 28. Finally, straps 54 and 56 are pulled tightly over panel 12 and are adjustably secured to panel 28 by locking fasteners 44 and 42 in their respective openings 62 and 64.

Once the holder is in place, the type of brush it contains can be determined by inspecting window 16. Window 16 allows one to learn not only if the brush is straight or angled by inspecting the slant of ferrule 70, but also provides information about the texture of bristles 72 and the material of which they are made.

Figure 3:
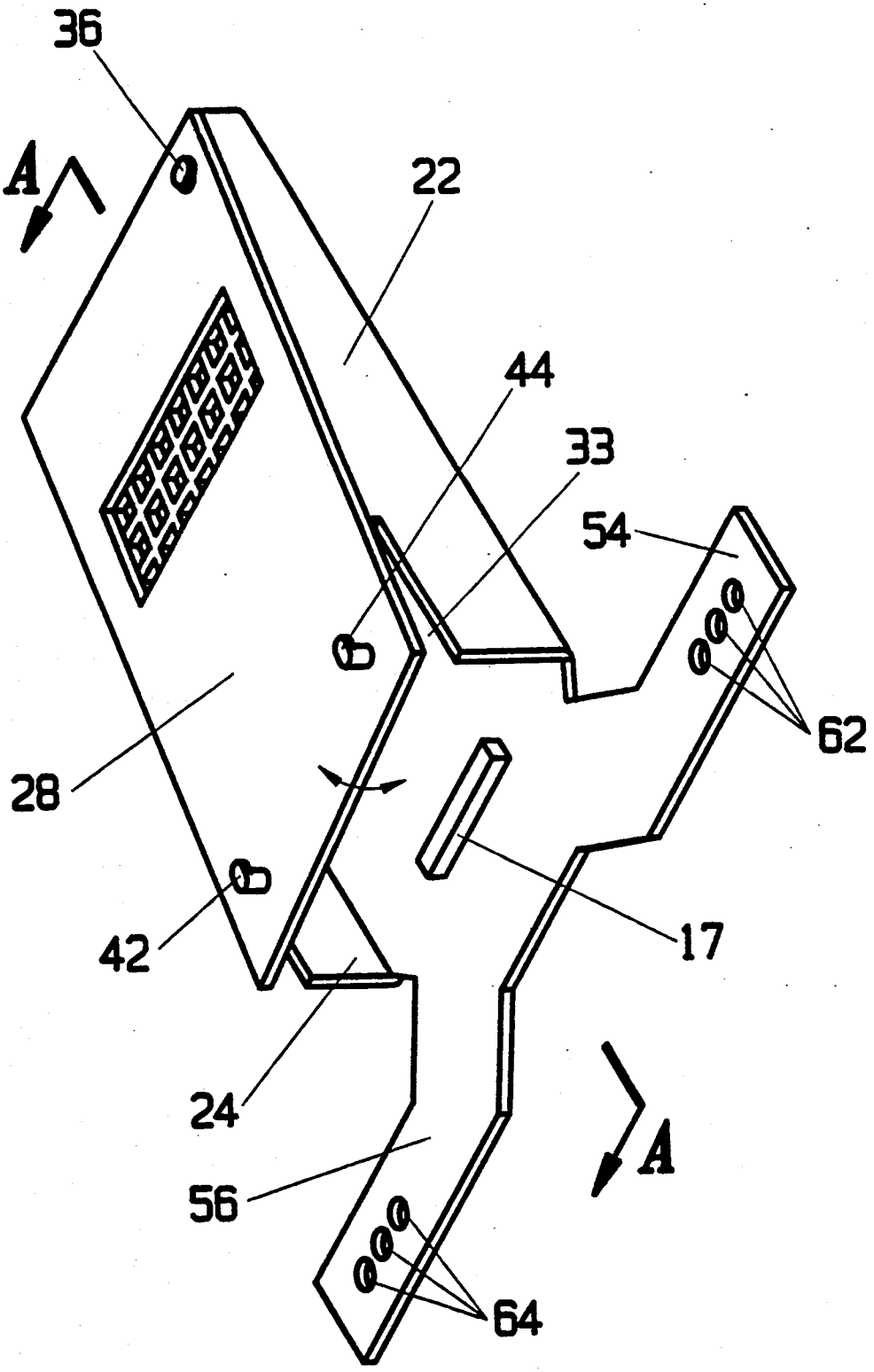
FIG. 3 is a perspective view of the partially folded holder of FIG. 1.
Figure 4:
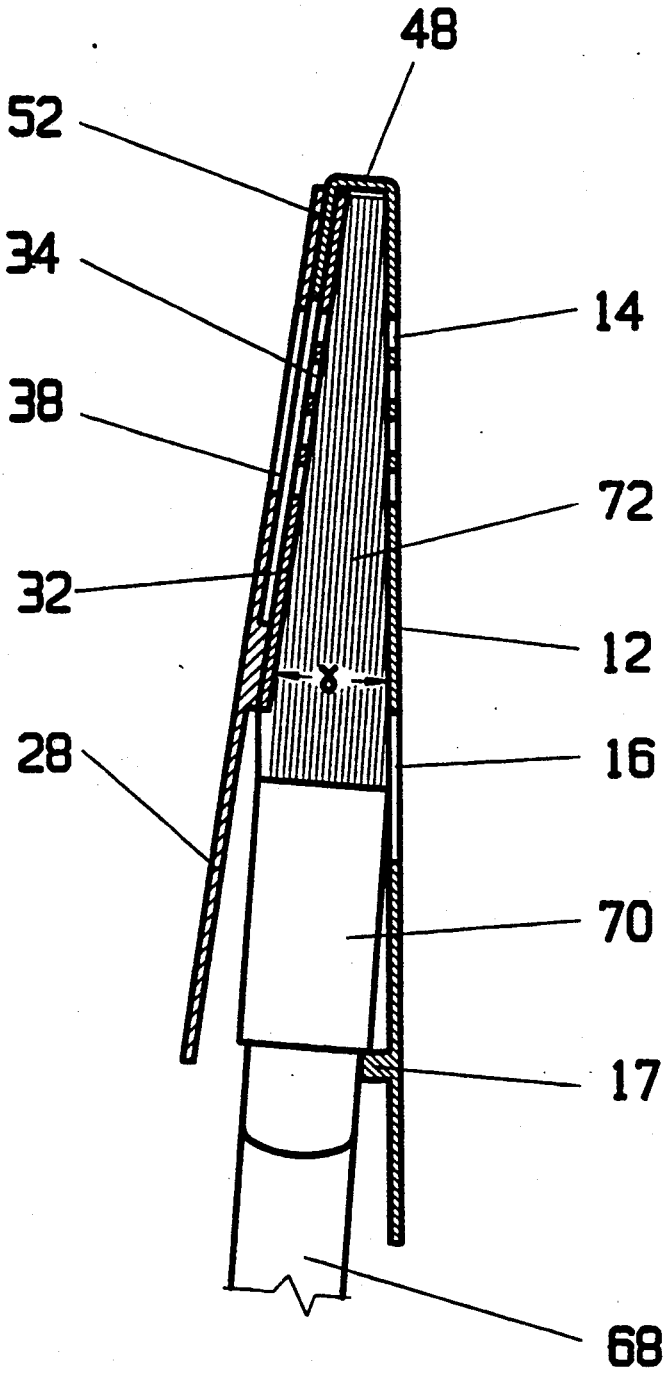
FIG. 4 is a cross-sectional view of the holder of FIG. 3 taken in the direction indicated by lines A—A.

As illustrated in FIGS. 3 and 4, cutout 33 permits the holder to accommodate brushes of different thicknesses. Cutout 33 allows the top portion of panel 28, exposed by cutout 37, to flex upwardly. This upward deflection substantially enlarges the mouth of the opening formed by the folded paintbrush holder. Conversely, the top portion of panel 28 can also deflect downwardly to reduce the size of the opening. Once straps 54 and 56 are adjustably fastened to panel 28, brush 66 contained inside the holder is tightly squeezed and is firmly held in place by the exposed portion of panel 28, regardless of the thickness of ferrule 70.

As shown in FIG. 4, raised portion 17, which rests against the edge of ferrule 70, ensures that bristles 72 are forced into a taper having angle $\alpha$.

In combination with the adjustability of straps 54 and 56 and the tapered design of panels 22 and 24, the flexibility of panel 28 also permits the holder to accommodate brushes with different bristle lengths. Ventilation openings 14 and 34 allow the bristles to dry quickly after the brush has been washed in water or solvent. The size and the number of the openings are adequately large for thorough ventilation of bristles 72, but the openings are small enough to prevent the bristles from accidentally protruding outside the holder.

SUMMARY, RAMIFICATIONS, AND SCOPE

Thus, it has been shown that I have provided a greatly improved paintbrush holder which can display and ventilate the brush bristles while still providing a high degree of protection of the bristles and ferrule, which accommodates brushes of a given width with different ferrule thicknesses, different bristle lengths, and varying handle cross-sections, and which is simple and inexpensive to manufacture.

Although the brush holder has been shown and described in the form of one specific embodiment, its configuration and materials are given only as examples, and many other modifications of the holder are possible. For instance, openings 14 and 34 may have different shapes, e.g., round, square, oval, etc. and may be arranged in a variety of patterns. The snap-type fasteners of the holder may be replaced by fasteners of a different type, e.g., velcro closures, or the positions of the fasteners and their mating openings may be reversed. The brush holder may also be made of laminated paper, cardboard, or any other suitable material. The holder can be produced in a variety of sizes to accommodate brushes having different widths. Therefore, the scope of the invention should be determined, not by the examples given, but by the appended claims and their legal equivalents.

What I claim is:

1. A one-piece paintbrush holder for a paintbrush having bristles, a ferrule, and a handle, said holder having an inner face and an outer face, said holder comprising:

a main panel for covering one face of said paintbrush, said main panel including first circulation means for ventilating said bristles, viewing means for inspecting said bristles and said ferrule, and brush-supporting means for tapering said bristles at a specific angle;

a first side panel being foldably connected to a right side of said main panel, said first side panel having a taper from a top to a bottom thereof, said taper having said specific angle;

a second side panel being foldably connected to a left side of said main panel, said second side panel having said taper from the top to the bottom thereof and a wedge-shaped longitudinal cutout at a top thereof;

an intermediate panel foldably connected to a right side of said first side panel, said intermediate panel including second circulation means for ventilating the bristles of said paintbrush, the outer face of said intermediate panel having a first fastener;

a spacer panel foldably connected to a bottom side of said main panel;

a lower panel foldably connected to a bottom side of said spacer panel;

a front panel foldably connected to a left side of said second side panel, an outer face of said front panel having a second fastener and a third fastener, said front panel having an aperture large enough to expose said second circulation means once said intermediate panel and said front panel are folded, said front panel incorporating closure means for locking with said first fastener; and fastening means for adjustably locking with said second and third fasteners, said fastening means being attached to a top side of said main panel.

2. The holder of claim 1 wherein said holder is made of plastic.

3. The holder of claim 1 wherein said first circulation means and said second circulation means each comprise a plurality of openings.

4. The holder of claim 1 wherein said viewing means is an inspection window.

5. The holder of claim 1 wherein said brush-supporting means is a raised strip of material, said raised strip being located near said top edge of said main panel and being parallel thereto.

6. The holder of claim 5 wherein said raised strip is about 3 mm high.

7. The holder of claim 1 wherein said first, second, and third fasteners are snap fasteners.

8. The holder of claim 7 wherein said first fastener is located near said bottom side of said intermediate panel.

9. The holder of claim 8 wherein said intermediate panel is shorter than said first side panel by the length of said wedge-shaped longitudinal cutout.

10. The holder of claim 7 wherein said second and third fasteners are located near said top side of said front panel.

11. The holder of claim 1 wherein said closure means is an opening, located at said bottom side of said front panel.

12. The holder of claim 1 wherein said fastening means comprises two straps, each of which contains a plurality of holes of the same diameter, said holes matching said first and second fasteners.

13. The holder of claim 1 wherein said specific angle is approximately 10°.

14. A one-piece paintbrush holder for a paintbrush having bristles, a ferrule, and a handle, said holder having an inner face and an outer face, said holder comprising:

a main portion for covering one face of said paintbrush, said main portion containing a first plurality of ventilation openings, an inspection window for said bristles and said ferrule, and a raised strip being located near a top edge of said main portion and being parallel thereto;

a first side portion foldably connected to a right side of said main portion, said first side portion having a taper from a top to a bottom thereof, said taper having a specific angle;

a second side portion being foldably connected to a left side of said main portion, said second side portion having said taper from a top to a bottom thereof and a wedge-shaped longitudinal cutout at said top thereof;

an intermediate portion foldably connected to a right side of said first side portion, said intermediate portion containing a second plurality of ventilation openings, the outer face of said intermediate portion having a first snap fastener located near a bottom side of said intermediate portion, said intermediate portion being shorter than said first side portion by the length of said wedge-shaped longitudinal cutout;

a spacer portion foldably connected to a bottom side of said main portion;

a lower portion foldably connected to a bottom side of said spacer portion;

a front portion foldably connected to a left side of said second side portion, the outer face of said front portion having second and third snap fasteners located near a top side of said front portion, said front portion having an aperture large enough to expose said second plurality of ventilation openings once said intermediate and said front portions are folded, said front portion incorporating an opening for locking with said first snap fastener, said opening being located near a bottom side of said front portion; and two fastening straps, each having a plurality of holes for locking with said second and third fasteners, said fastening straps being attached to the top side of said main portion.

15. The holder of claim 14 wherein said holder is made of plastic.

16. The holder of claim 14 wherein said specific angle is about 10°.

17. The holder of claim 14 wherein said raised strip is about 3 mm high.

18. The holder of claim 14 wherein said inspection window is large enough to see the slant of said ferrule and the texture of said bristles.

* * * * *